US005829743A

United States Patent [19]

DeLand, Jr. et al.

[11] Patent Number: 5,829,743

[45] Date of Patent: Nov. 3, 1998

[54] GEAR-DRIVEN CARD TRANSPORT DEVICE

[75] Inventors: Robert S. DeLand, Jr., Torrance; Lawrence R. Meyers, Hermosa Beach; Richard G. Fisher, San Pedro, all of Calif.

[73] Assignee: Mag-Tek, Inc., Carson, Calif.

[21] Appl. No.: 606,644

[22] Filed: Feb. 27, 1996

[51] Int. Cl.[6] ..... B65H 5/06

[52] U.S. Cl. ..... 271/273; 271/272

[58] Field of Search ..... 271/264, 272, 271/273, 274, 314

[56] References Cited

U.S. PATENT DOCUMENTS

| | | | |
|---|---|---|---|
| 3,434,130 | 3/1969 | Lemelson . | |
| 3,924,847 | 12/1975 | Pescetto | 271/314 |
| 3,964,739 | 6/1976 | Garcia | 271/274 |
| 3,999,749 | 12/1976 | Zambolin et al. | 271/274 |
| 4,170,348 | 10/1979 | Hoeink et al. | 271/274 |
| 4,269,594 | 5/1981 | Umans et al. | 271/273 |
| 4,611,939 | 9/1986 | Fujiwara | 271/274 |

FOREIGN PATENT DOCUMENTS

| | | | |
|---|---|---|---|
| 0236139 | 9/1989 | Japan | 271/264 |

OTHER PUBLICATIONS

KDE General Catalog 1, "Card Reader/Writer Comprehensive, Competitive Up–to–Date" (date uinknown).

Neuron MTS Series, Neuron Corporation, Tokyo, Japan (date unknown).

Pages from Hopt–Schuler catalog (date unknown).

Pp. 24, 29 and 33 from Omron catalog (date unknown).

Product information sheets on Sankyo "Sanac" Mag & IC Card Reader and Magnetic Card Readers.

*Primary Examiner*—H. Grant Skaggs

*Attorney, Agent, or Firm*—Darby & Darby

[57] ABSTRACT

A data-bearing card is transported past a reading, writing or other communication head by at least one drive element connected to an electric motor through a preselected gear train. The mechanism moves the card at speeds corresponding to a preferred range of rates at which data borne by the card is intended to pass the communication head, and does so with a minimum of "jitter". In one particular embodiment, the gear train includes a worm screw driving a worm wheel for rotation with the drive element. In another embodiment, the electric motor is supported on a base oriented substantially parallel to the card being transported, and a shaft carrying the drive element and a first gear of the gear train is supported for rotation by at least one side plate detachably mounted to the base.

22 Claims, 6 Drawing Sheets

SPECTRUM OF BIT TIMING VARIATIONS

GEAR-DRIVEN CARD TRANSPORT DEVICE

BACKGROUND OF THE INVENTION

The present invention relates to a card transport device and, more particularly, to a gear-driven device for moving a data-bearing card past a reading, writing, or other communication head.

Motorized devices are used to transport data-bearing cards (such as credit cards, debit cards, "smart cards," "bar" coded cards, "thin flexible cards," and the like) past reading or writing heads in a variety of circumstances. One example is the common automatic teller machine (ATM) which takes deposits and dispenses cash on the basis of a card having information about the cardholder and the cardholder's account stored on a magnetic stripe or other data-bearing structure.

Information is read from and written to magnetic stripe cards according to preselected industry standards, typically those of the International Standards Organization ("ISO"). ISO standard 7811/2 for "Track 1" information provides for information to be stored at a density of two hundred ten bits per inch, allowing 0.00476 inches (0.121 mm) per bit, and the same standard for "Track 2" information provides for information to be stored at a density of seventy-five bits per inch, allowing 0.0133 inches (0.338 mm) per bit. For a given rate of card movement, typically within the range of five to twelve inches (12.7–30.5 cm) per second, each different bit density gives rise to a characteristic timing of bits which must be decoded or encoded by an associated electronic device.

Errors encountered in a read or write process, which are commonly called "jitter", manifest themselves as variations in the timing of signals obtained when a card is read back. For these purposes, jitter has components arising from mechanical variations in the card's velocity, spatial variations in bit locations on the card, electronic variations in decoding and amplification circuitry, and wear factors, such as scratches on a card's magnetic stripe. Total jitter of the read or write process, which is the sum of the individual jitter components, must be kept below approximately twenty-five percent (25%) if the information is to be usable. Above that level, the binary "1's" and "0's" become indistinguishable from one another.

In designing motorized card transport devices, extreme care must be taken to minimize mechanical variations in card velocity which contribute to system jitter. Prior card transport devices typically do not make use of direct gear couplings, for example, because such couplings are known to create jitter each time two teeth make or break physical contact. This phenomenon is known as "cogging". Instead of gears, designers of card transport devices have resorted to expensive stepper motors, precision-controlled DC motors, drive belts and substantial flywheels to impart smooth, uniform movement to data-bearing cards. These components are not only expensive, but they complicate the devices and make them prone to malfunction.

Therefore, it is desirable in many applications to provide a simple and economical device for moving a data-bearing card past a reading, writing, or other communication head with a minimum of jitter.

SUMMARY OF THE INVENTION

Despite the common belief that gears, and particularly worm gears, are not suitable for use in precision card transport devices, a gear-driven device constructed according to the present invention transports data-bearing cards at all commercially significant rates with extremely low mechanical jitter. The disclosed device is also simple and inexpensive, yet has a long useful life. In a preferred embodiment, a simple DC electric motor operates through spur gears to drive a worm screw which engages a worm wheel mounted for rotation with a pair of drive rollers in contact with the card's surface. The coupling between the motor and the drive rollers is therefore preferably "direct" in the sense that there are no intervening belts or resilient rollers.

The characteristics of the gear train, and particularly the worm gear set, are specifically chosen to minimize mechanical jitter. This can be done empirically by measuring mechanical jitter for different gear combinations, or mathematically by calculating the percentage of error caused by jitter at each relevant frequency. When a card bearing Track 1 or Track 2 information is transported at a rate within the range of approximately five to twelve inches (12.7–30.5 cm) per second, and preferably approximately ten inches (25.4 cm) per second, jitter is minimized by a worm gear set providing approximately eleven worm wheel tooth engagements/disengagements per inch (4.3 engagements/disengagements per centimeter) of card travel.

The card transport device may include a base supporting the electric motor and the worm screw, and at least one side plate detachably mounted to the base to support a transverse drive shaft. In one form, the device has an upper plate above the base and a plurality of alignment tabs orienting the side plate relative to the base. This structure greatly simplifies alignment of the drive shaft and the other components when the device is initially assembled. Likewise, it permits the device to be disassembled and reassembled easily during repair. Instead of having numerous individual shafts requiring meticulous assembly and alignment, as encountered in many prior art card transport devices, applicants' device is relatively simple and can be assembled rapidly by unskilled workers.

Thus, the invention relates to a card transport device for moving a data-bearing card past a reading, writing, or other communication head during a data reading or writing operation, comprising: an electric motor; a gear train driven by the motor and having a worm screw engaging a worm wheel; and at least one drive element coupled to the gear train and engageable with the card to move the card at speeds corresponding to a preferred range of rates at which data borne by the card passes the communication head. In one embodiment, the drive elements comprise rollers having resilient surface portions frictionally engaging the card. The worm wheel can then be mounted for rotation with the drive element about a preselected drive axis, and the worm screw can be mounted for rotation about an intermediate axis substantially perpendicular to the drive axis.

Alternatively, a card transport device of the invention includes: a base oriented along a plane substantially parallel to the card and having opposite side portions; an electric motor supported by the base; a first gear mounted for rotation relative to the base and driven by the electric motor; at least one side plate detachably mounted to one of the side portions; and a drive element shaft journaled for rotation within the side plate, the drive element shaft carrying a second gear driven by the first gear and at least one drive element engageable with the card. In this configuration, the transport device preferably includes a pair of side plates mounted to the side portions of the base, and an upper plate located above the base and held in place by the side plates.

BRIEF DESCRIPTION OF THE DRAWINGS

The above and other features of the present invention may be more fully understood from the following detailed description, taken together with the accompanying drawings, wherein similar reference characters refer to similar elements throughout and in which.

DESCRIPTION OF THE PREFERRED EMBODIMENTS

Figure 1:
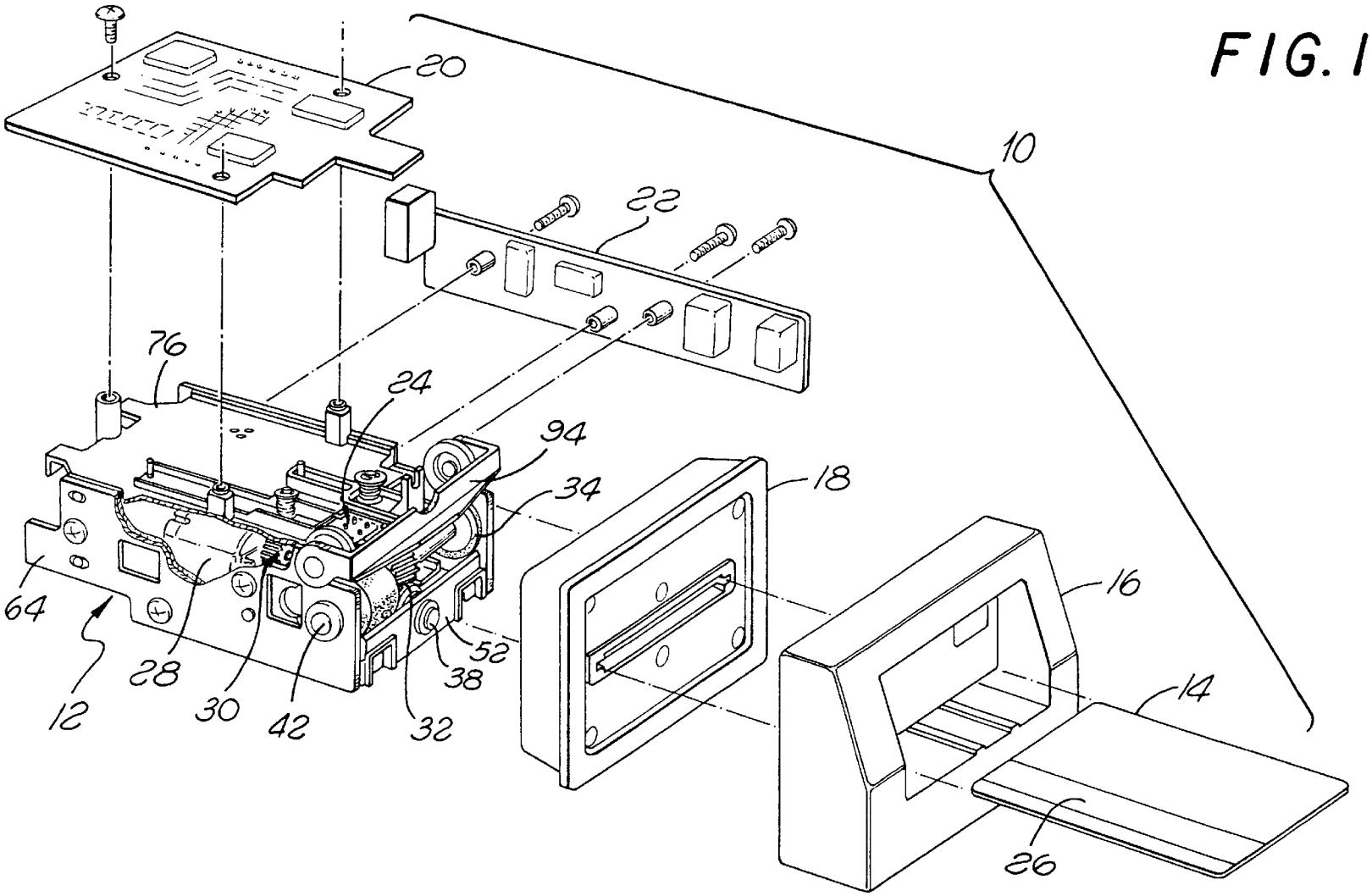
FIG. 1 is a partially exploded isometric view, partially broken away, of a card reader having a card transport device constructed in accordance with the present invention, shown with a data-bearing card in position for insertion therein.
Figure 2:
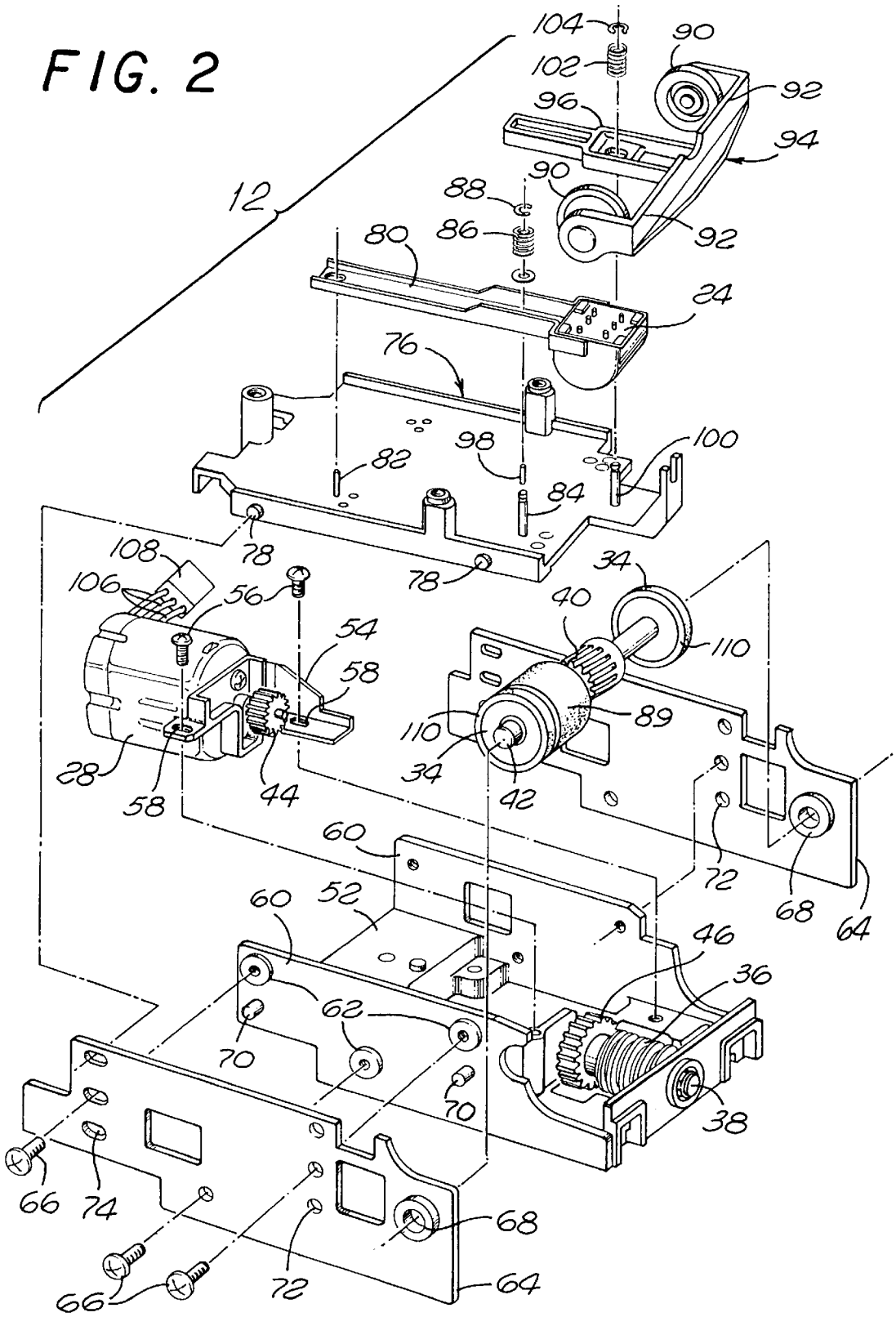
FIG. 2 is an exploded isometric view of the card transport device of FIG. 1.

Referring now to the drawings, specifically FIGS. 1 and 2, a card reader 10 constructed according to one embodiment of the present invention has a card transport device 12 which receives a data-bearing card 14 through a decorative outer bezel 16 and a protective inner bezel 18. The transport device 12 is controlled in part by a circuit board 20 and a sensor plate 22 to move the data-bearing card 14 past a magnetic or other head assembly 24 in a smooth, uniform motion with minimum jitter. This permits information to be read from or written to a magnetic stripe or other data bearing structure 26 of the card 14 with a high degree of accuracy.

The card transport device 12 moves the data-bearing card using an electric motor 28 which acts directly through a gear train composed of a primary gear set 30 and a secondary gear set 32 to drive a pair of rollers or other drive elements 34 in contact with the underside of the card. In the illustrated embodiment, the primary gear set 30 is a spur gear set and the secondary gear set 32 is a worm gear set. It is through the design of this gear train that applicants have successfully minimized the mechanical jitter present in motion imparted to the card. This is accomplished by providing all of the gears, and particularly a worm wheel of the worm gear set, with preselected design characteristics for which sinusoidal variations in card velocity are drastically reduced at conventional rates of card movement. The characteristics having the greatest effect are the pitch and diameter of the worm gear set.

Figure 3:
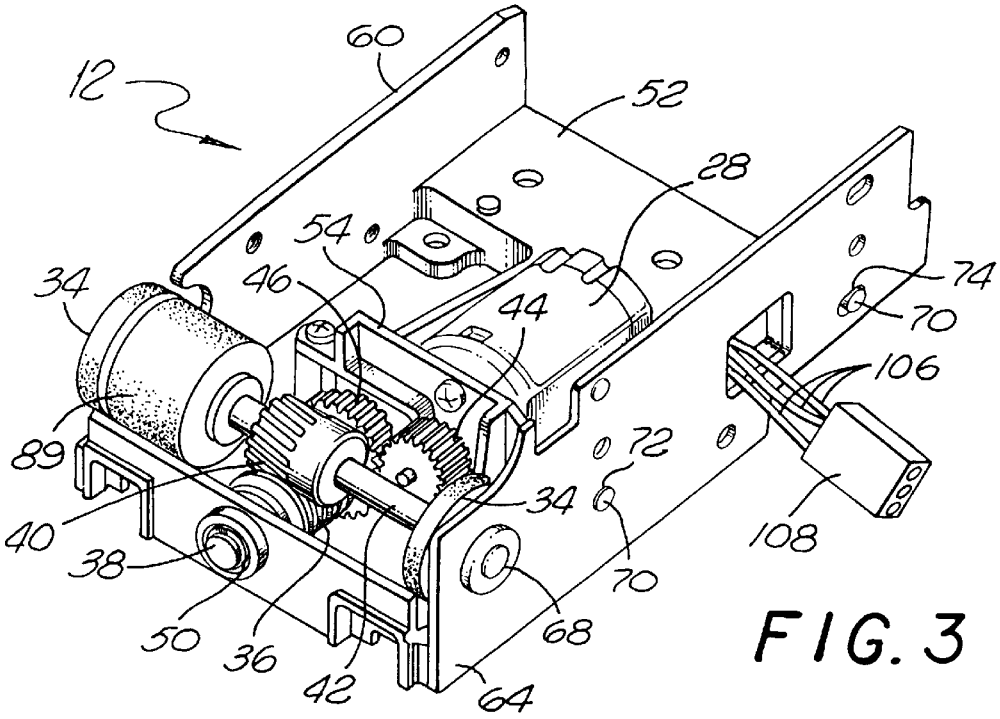
FIG. 3 is an isometric view from the opposite side showing the card transport device of FIG. 2 with its left hand side plate and its upper plate removed.
Figure 4:
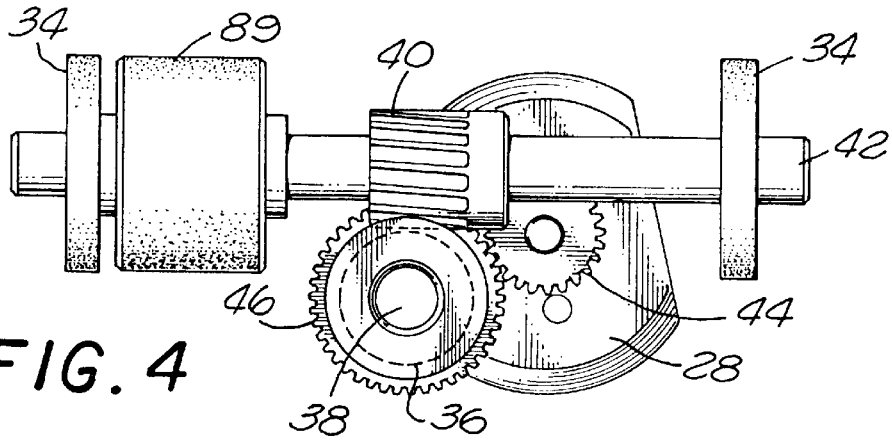
FIG. 4 is a front elevational view of the drive train of the card transport device of FIG. 2, shown in isolation.
Figure 5:
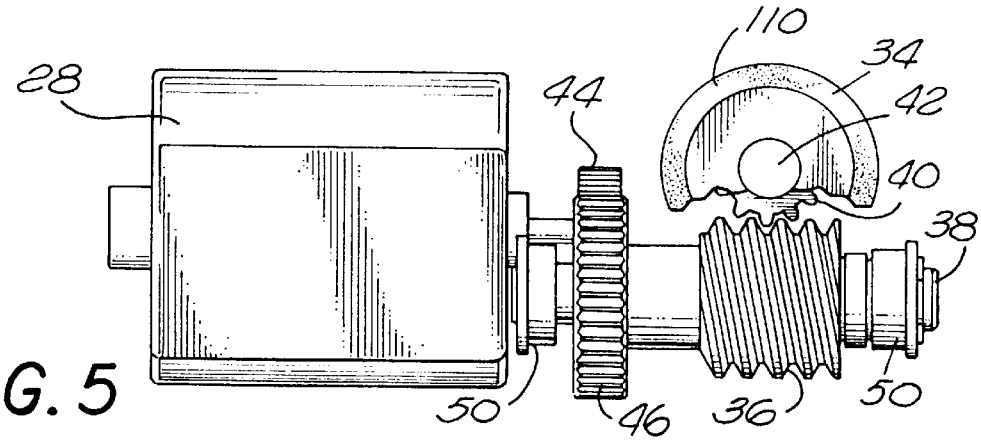
FIG. 5 is a side elevational view of the structure of FIG. 4, with one of the drive rollers partially broken away to reveal the worm gear set.

Referring now specifically to FIGS. 2 and 3, in the illustrated embodiment, the worm gear set 32 is made up of a first gear 36 in the form of a worm screw mounted for rotation on an intermediate gear shaft 38, and a second gear 40 in the form of a non-enveloping helical worm wheel keyed to a transverse drive shaft 42 associated with the drive rollers 34. The spur gear set 30 is then made up of a first spur gear 44 mounted to an output shaft of the motor 28 and a second spur gear 46 keyed to the worm screw 36 on the intermediate gear shaft 38. The details of these gears and their relationships to one another are shown most clearly in FIGS. 4 and 5. Thus, the motor 28 drives the drive rollers 34 through the first spur gear 44, the second spur gear 46, the worm screw 36 and the helical worm wheel 40.

In the illustrated embodiment, the intermediate gear shaft 38, which carries the second spur gear 46 and the worm screw 36, rotates about an axis substantially parallel to the direction of card travel, whereas the drive shaft 42 is substantially perpendicular to that direction. The spur gear set 30 and the worm gear set 32 can then reduce the drive speed from approximately 8000 revolutions per minute (rpm) at the motor 28, to approximately 5000 rpm at the intermediate gear shaft 38, and ultimately to approximately 300 rpm at the drive roller shaft 42. The drive rollers 34 may then be 0.625 inches (1.59 cm) in diameter, imparting a speed of approximately 10 inches per second (25.4 cm per second) to the data-bearing card 14.

When gears are used in a motorized card transport device, repeated engagements and disengagements of gear teeth create unwanted variations in the timing of readback signals. Of the two gear sets of the card reader 10, the worm gear set 32 contributes significantly more to mechanical jitter of this type. By carefully selecting the characteristics of the worm screw 36 and the worm wheel 40 to minimize mechanical jitter, the overall jitter of the transport device 12 is reduced far below that previously considered possible in gear drive systems. Although several characteristics of these gears play a part in system jitter, the most critical characteristics are the pitch and diameter of the worm wheel 40. Taken together, they determine the number of gear tooth engagements and disengagements per unit of card movement.

The characteristics of the worm wheel 40 can be explored empirically, by constructing card transport devices having different worm wheel characteristics and measuring the jitter of each device in operation, or mathematically, by calculating the harmonic variations in card velocity at different rates of engagement and disengagement of the teeth of the worm wheel 40 relative to the worm screw 36. For purposes of this discussion, the rate of worm wheel engagement and disengagement is referred to as the "gear tooth rate", expressed in cycles per inch.

Figure 6:
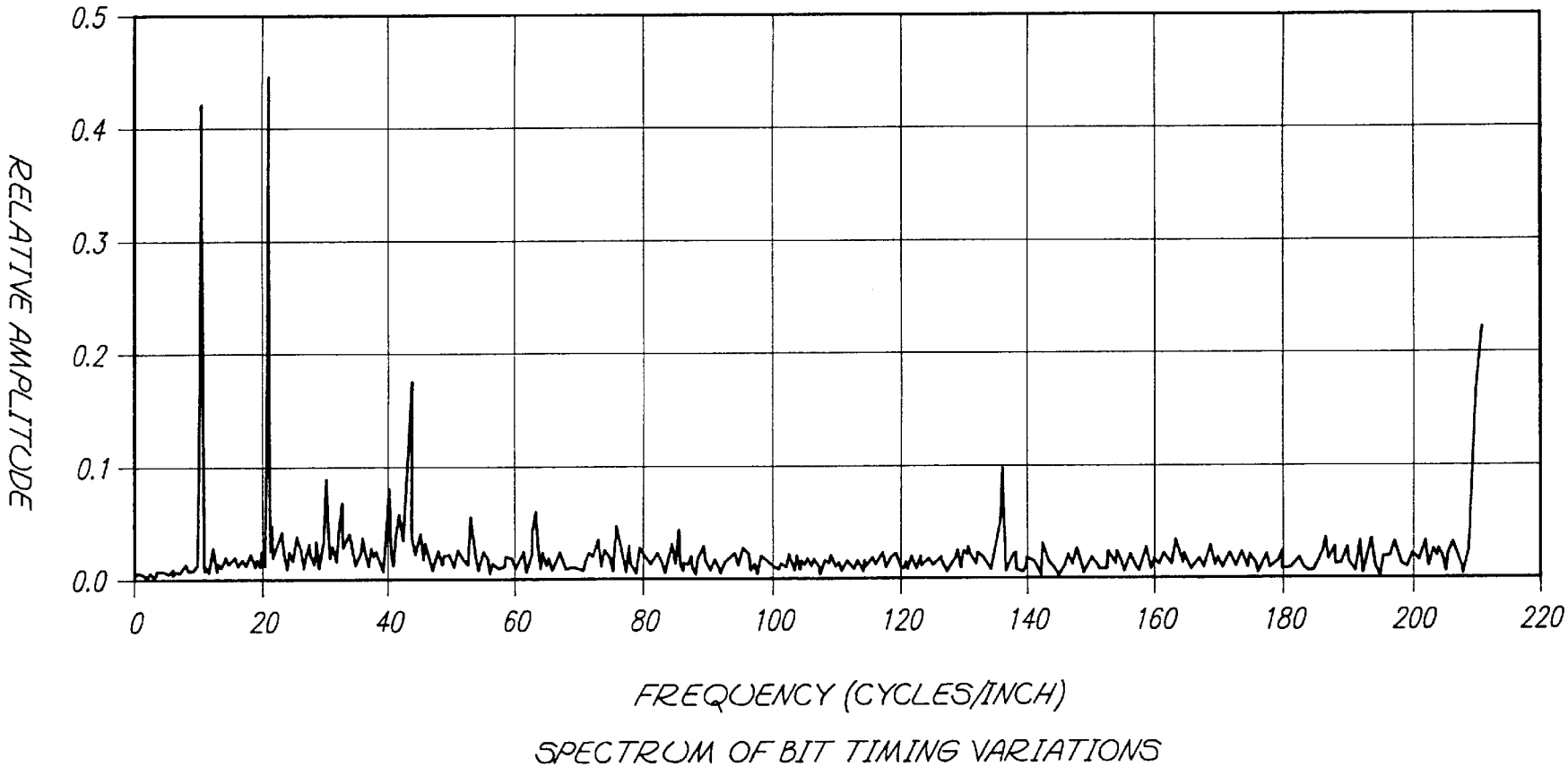
FIG. 6 is a graph of the Fourier transform of spacings between bits recorded on a magnetic card and bits played back from the card using the card transport device of FIG. 1, plotted as a function of frequency (cycles/inch)

With respect to the gear-driven card reader 10, FIG. 6 is a graph of the Fourier transform of measured spacings between bits recorded on a magnetic card and bits played back from the card with the reader 10. The horizontal axis is expressed as cycles per inch rather than traditional time-based frequency units. FIG. 6 shows a spectral peak at 10.5 teeth per inch of card travel for the worm wheel while the second peak is a second harmonic caused by the fact that engagement and disengagement of the gears is not symmetrical. The third (smaller) peak is the 4th harmonic, and so on.

By comparing the spectral lines of FIG. 1 to the gear tooth rates of the reader, we learn the relative contribution of each gear to the overall speed variation of the reader. It is clear from FIG. 6 that the worm wheel is the major contributor to speed variation. According to the teachings of the invention, optimization reduces the magnitude of these spectral lines.

Figure 7:
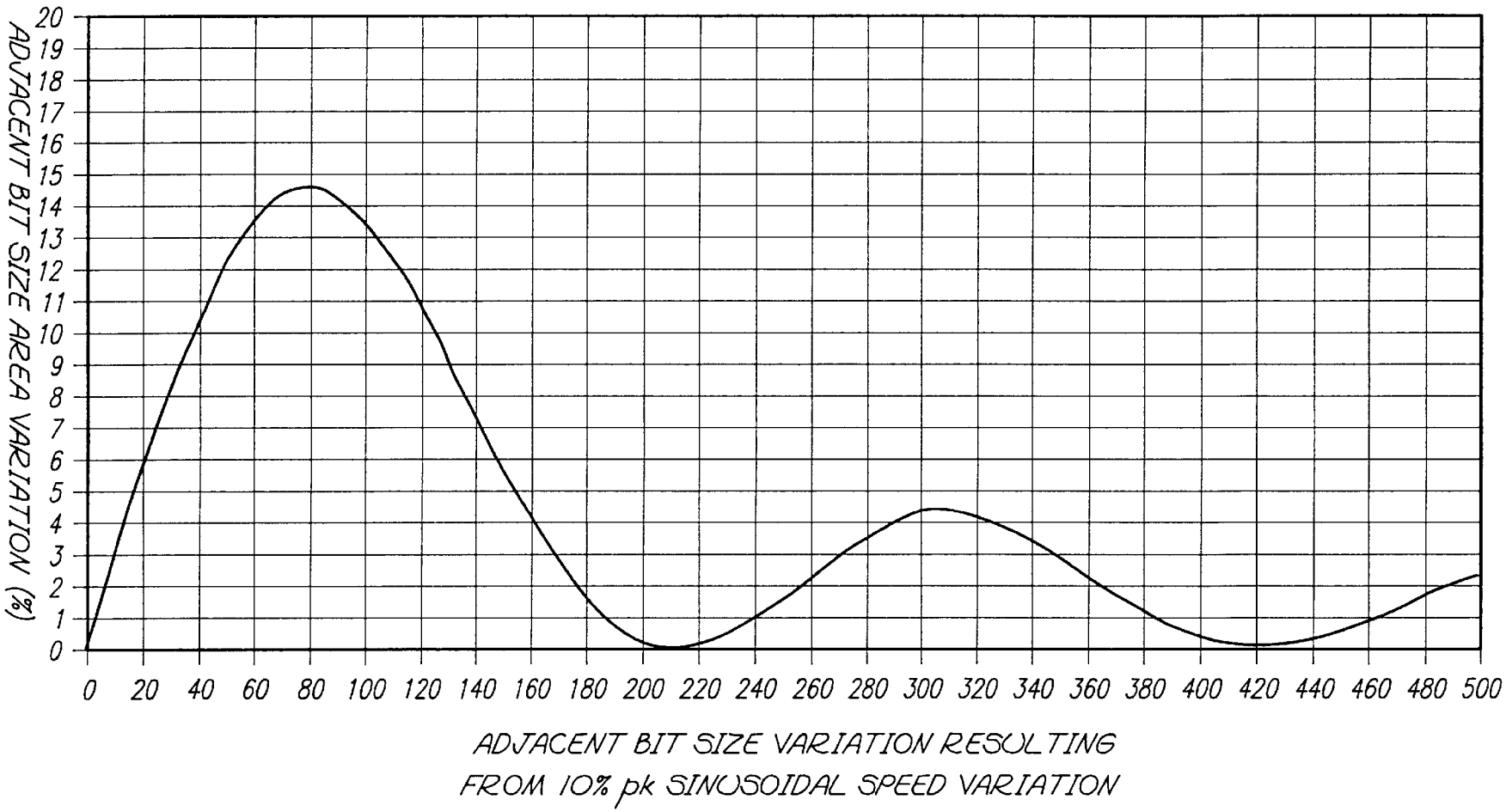
FIG. 7 is a graph of the first order approximation of the theoretical adjacent bit size variation resulting from ten percent (10%) peak variation in card velocity due to gear pitch, plotted as a function of gear tooth rate (cycles/inch) for a data rate of 420 flux reversals (210 cycles) per inch.

Optimization is achieved by improving the quality of the gears and their engagements, and correctly selecting the pitch (number of teeth) and diameter of each gear for a particular data rate. In this regard, it is important to recognize that there is a relationship between adjacent bit size variation and the pitch of a particular gear. FIG. 7 illustrates the theoretical adjacent bit size variation resulting from ten percent (10%) peak variation in velocity due to gear pitch, plotted as a function of the gear tooth rate, for a data rate of 420 flux reversals (210 cycles) per inch. Such a graph can be determined for any relevant data rate.

Figure 8:
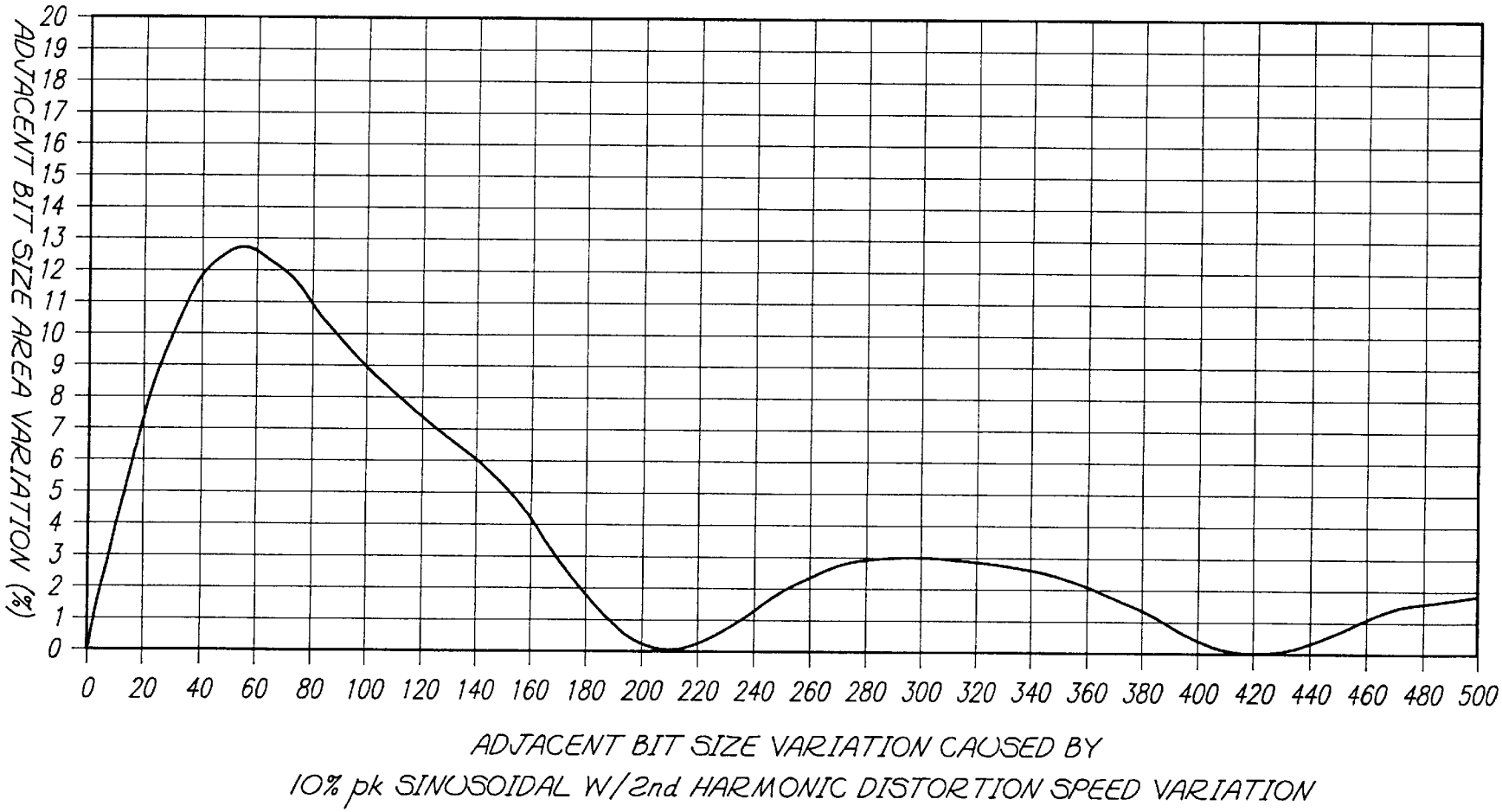
FIG. 8 is a graph of the adjacent bit size variation function of FIG. 7 to which the second harmonic has been added.

FIG. 7 shows that there are particular gear tooth rates, and thus gear pitches, where adjacent bit size variation is reduced or eliminated. These particular rates are dependent on the data rate and, because of mechanical constraints, often cannot be achieved in the card transport devices of the present invention. However, adjacent bit size variation can be reduced significantly if the gear pitch is changed so there are fewer teeth (cycles) per inch. From FIG. 6, we see that the analysis should include the second harmonic. FIG. 8 is the adjacent bit size variation if the second harmonic is added.

Because the ISO standards for bit density on Track 1 and Track 2 are different, and because binary "0's" and binary "1's" are defined by different numbers of magnetic flux reversals, there are actually four frequencies which must be considered with respect to Track 1 and Track 2 information. Thus, the ISO 7811/2 standard for Track 1 is 210 bits per inch (BPI), yielding 210 flux reversals per inch (FRPI) for a string of binary "0's" and 420 FRPI for a string of binary "1's". Although each of these frequencies corresponds to bits having an individual physical size of 0.00476 inches (0.121 mm), they nevertheless must be considered separately for purposes of jitter analysis. Similarly, the ISO 7811/2 standard for Track 2 information is 75 BPI, corresponding to 75 FRPI for a string of binary "0's" and a frequency of 150 FRPI for a string of binary "1's". Graphs similar to FIGS. 7 and 8 can be obtained for each of these four frequencies.

When the gear tooth rates of the mechanism are lower than the gear tooth rate of the first peak of FIG. 7 or FIG. 8, then the rates of the mechanism have a more pronounced effect on the reading of information encoded at lower data rates than on the reading of information encoded at higher data rates. Therefore, a solution that minimizes jitter for the reading density of 75 FRPI is often acceptable for the other reading densities.

In accordance with the present invention, it has been found that the mechanical jitter produced by the card transport device 12 is extremely low when the worm wheel 40 has 15 teeth with a diametral pitch of 48. This corresponds to approximately 11 gear tooth engagements/disengagements per inch (4.3 engagements/disengagements per centimeter). More specifically, the total mechanical jitter created by the card transport device 12 is less than five percent when the spur gear set 30 and the worm gear set 32 are made up of the following components:

Worm Screw 36

Diametral pitch: 48

Single thread-right hand

Pressure angle: 20°

Pitch diameter: 0.4375 inches (1.11 cm)

Lead: 0.0655 inches (1.66 mm)

Lead angle: 2.7263°

Worm Wheel 40

Diametral pitch 48

Fifteen teeth—right hand

Pressure Angle: 20°

Pitch diameter: 0.3125 inches (0.794 cm)

Lead: 0.0655 inches (1.66 mm)

Lead angle: 2.7263°

First Spur Gear 44

Diametral pitch: 72

Pressure angle: 14.5°

Number of teeth: 24

Pitch diameter: 0.3333 inches (0.845 cm)

Base diameter: 0.3227 inches (0.819 cm)

Outside diameter: 0.3700 inches (0.940 cm)

Second Spur Gear 46

Diametral pitch 72

Pressure Angle: 14.5°

Number of teeth 42

Pitch diameter: 0.5833 inches (1.48 cm)

Base diameter: 0.5647 inches (1.43 cm)

Outside diameter: 0.617 inches (1.57 cm)

Another significant aspect of the card transport device 12 is the simplicity of its design and the ease with which it can be manufactured. With reference again to FIGS. 2, 3 and 5, the intermediate gear shaft 38 is journaled within bushings 50 of a base structure 52. Behind the intermediate gear shaft 38, the motor 28 is releasably mounted to the base 52 by a mounting bracket 54 (FIG. 2) which is held in place by a plurality of threaded fasteners 56 so the first spur gear 44 on the output shaft of the motor engages the second spur gear 46 of the intermediate gear shaft. The structure of the mounting bracket 54 facilitates alignment of the spur gears and permits them to be adjusted by lateral motion of the mounting bracket relative to the base. A preselected amount of such motion is permitted by apertures 58 of the mounting bracket 54 which are elongated in a lateral direction. Once a desired condition of engagement is achieved, the motor 28 and the mounting bracket 54 are tightened in position with the threaded fasteners 36.

As illustrated in FIG. 2, the base structure 52 has a pair of opposed side portions 60 which are substantially vertical and have threaded bosses 62 for attaching respective side plates 64 using threaded fasteners 66. The side plates 64 also carry bushings 68 at their forward ends to journal the transverse drive shaft 42 for the rotational motion described above. Accurate alignment of the side plates 64 relative to the side portions 60 of the base 52 is achieved by a plurality of alignment tabs or "pins" 70 projecting outwardly from the side portions 60 to engage openings 72 and 74 of the side plates 64. The openings 72 are located near the forward ends of the side plates 64 and are dimensioned to closely engage the alignment tabs 70, restraining the side plates 64 from translational movement relative to the alignment tabs. The openings 74 are located closer to the rear of the side plates 64, however, and are elongated in the front-to-back direction to facilitate assembly of the device. The openings 74 thus prevent rotational movement of the side plates 64 relative to their respective openings 72, locking the side plates 64 in place relative to the side portions 60 of the base 52.

The card transport device 12 also contains an upper plate 76 which itself has alignment tabs 78 engaging respective openings 72 and 74 of the side plates 64. This engagement is the same as that described above regarding the base structure 52, with the openings 72 fitting closely about the alignment tabs 78 and the openings 74 being elongated.

The upper plate 76 supports the head assembly 24 for contact with the magnetic stripe or the data-bearing structure 26 of the card 14. The head assembly 24 has an arm 80 which overlies the upper plate 76 and is penetrated by a pair of posts 82 and 84 extending from the upper plate. The arm 80, and thus the head assembly 24, is urged toward the surface of the upper plate by a spring 86 which surrounds the post 84 and is located above the arm. The spring is held in place by a clip 88 engaging the upper end of the post 84 to force the arm 80 and the head assembly 24 downwardly against the data-bearing structure 26 of the card.

A free-wheeling positioning roller 89 is located on the drive shaft 42 at a location directly below the head assembly 24, to prevent distortion of the card away from the head assembly. This serves to eliminate any components of system jitter resulting from the presence of a gap between the head assembly and the data-bearing structure 26.

A pair of backup rollers 90 are also forced downwardly against the data-bearing card at the location of the drive rollers 34. The backup rollers 90 are mounted to opposite arms 92 of a backup roller bracket 94 in the general configuration of a "whiffle tree". The arms 92 are attached to opposite sides of a central body portion 96 of the bracket which is biased downwardly against the upper plate 76 in much the same way as the head assembly 24. Thus, the central body portion 96 fits over posts 98 and 100, with a spring 102 positioned about the post 100 and held in place by a retaining clip 104. Thus, the backup rollers 90 force the card downwardly against the drive rollers 34 to eliminate any component of mechanical jitter resulting from card slippage.

The unique structure of the card transport device 12 allows it to be assembled easily and without skilled labor because there are no shafts or other elements which must be aligned manually. The only adjustment of any kind is that of the motor 28, which is performed by merely sliding the motor transversely to the desired position of engagement between the spur gears and tightening the motor in place. The intermediate gear shaft 38 is assembled within preformed openings of the base structure 52, whereas the drive shaft 42 is held in place by the side plates 64. The side plates themselves are aligned precisely by the alignment tabs 70 engaging openings 72 and 74 of the side plates and are positioned laterally by the threaded bosses 62. This permits the device to be easily and inexpensively manufactured and, if necessary, disassembled and repaired in the field by simply replacing standard parts.

In operation, the motor 58 of the card transport device 12 is connected to the circuit board 20 and the sensor plate 22 of the card reader 10 (FIG. 1) by leads 106 and a connector 108 (FIG. 2). The circuit 20 serves as a "read" or "write" amplifier of the system and is connected to the head assembly 24 for this purpose. In addition, it controls the operation of the motor 28. The sensor plate 22 detects the location and progress of the data-bearing card 14 through the card reader 10 and transmits this information to the circuit board 20 for motor control.

When a user inserts a data-bearing card 14 into the bezels 16 and 18 of the card reader 10, the sensor plate 22 detects the presence of the card and signals the circuit board 20 to activate the motor 28 and draw the card into the reader. The card is moved in this way by the spur gear set 30 and the worm gear set 32, resulting in rotation of the drive rollers 34 adjacent the card. Because the card is confined between the spring-loaded backup rollers 90 and the drive rollers 34, the card is drawn positively into the reader. The drive rollers are also provided with an outer ring 110 of a resilient, rubber-like material, such as urethane, which grips the card 14 in a positive manner. At the same time, the head assembly 24 is forced downwardly against the data-bearing structure 26 of the card 14, while the card in this region is forced upwardly against the head assembly 24 by the free-wheeling positioning roller 89 of the drive shaft 42. During this process, the gear train of the card transport device 12, and especially the worm gear set 32, act to provide gear reduction with a total mechanical jitter of less than five percent.

From the above, it can be seen that an apparatus according to the present invention for moving a data-bearing card past a reading, writing, or other communication head, is uniquely capable of performing its task with a minimum of jitter and yet is inexpensive to manufacture and repair.

While specific preferred embodiments of the invention have been disclosed, the invention is not limited to those particular forms, but rather is applicable broadly to all such variations as fall within the scope of the appended claims. For example, the transport device of the invention may be used to read, write, or both read and write information relative to a data-bearing card, and the data can be carried by the card in any of a variety of different forms, including without limitation magnetic stripes, semiconductor chips or bar codes. In addition, the gear train of the discussed structure may take any of a variety of different forms, but preferably couples the drive motor directly to the drive wheels (i.e., coupled to the drive wheels without intervening belts or resilient rollers).

What is claimed is:

1. A card transport device for moving a data-bearing card with a minimum of jitter during a data reading or writing operation, comprising:

at least one reading writing or other communication head;

an electric motor;

a gear train driven directly by said motor and including a worm screw engaging a worm wheel;

at least one drive roller coupled directly to said gear train and engageable with said card to move the card past said communication head at speeds corresponding to a preferred range of rates with a minimum of jitter; and a backup roller disposed to urge the card against the drive roller.

2. The card transport device of claim 1 wherein:

said drive roller has a resilient surface portion for contacting said card.

3. The card transport device of claim 1 wherein:

said worm wheel is mounted for rotation with said at least one drive roller about a preselected drive axis.

4. The card transport device of claim 3 wherein:

said worm screw is driven by said electric motor for rotation about an intermediate axis substantially perpendicular to said drive axis and, in turn, drives said worm wheel.

5. The card transport device of claim 4 wherein:

said worm screw is driven by said electric motor through a plurality of spur gears.

6. The card transport device of claim 1 wherein:

said worm wheel and said at least one drive roller are mounted to a drive shaft for common axial rotation;

said worm screw is mounted to an intermediate gear shaft for rotation about an axis substantially perpendicular to said drive shaft to drive said worm wheel; and said worm screw is driven by said electric motor.

7. The card transport device of claim 6 wherein:

said worm screw is driven by said electric motor through a plurality of spur gears.

8. The card transport device of claim 6 wherein:

said electric motor has an output shaft;

one of said spur gears is mounted to said output shaft; and another of said spur gears is mounted for rotation with said intermediate gear shaft.

9. The card transport device of claim 6 wherein:

said electric motor is affixed to a mounting bracket; and said mounting bracket is releasably attached to a stationary base portion of the card transport.

10. The card transport device of claim 6 wherein:

said gear train and said at least one drive roller are constructed to move said card past said communication head at speeds within a range of approximately 5–12 inches per second.

11. The card transport device of claim 6 wherein:

said gear train and said at least one drive roller are constructed to move said card past said communication head at a speed of approximately 10 inches per second.

12. The card transport device of claim 6 wherein:

said electric motor operates at approximately 6000–8000 revolutions per minute.

13. The card transport device of claim 12 wherein:

said at least one drive roller rotates at approximately 300 revolutions per minute as said card is moved.

14. The card transport device of claim 6 wherein:

said worm screw and said worm wheel are constructed and arranged to provide a preselected number of worm wheel tooth engagements per unit of card movement.

15. The card transport device of claim 14 wherein:

said preselected number of worm wheel tooth engagements is approximately 11 per inch.

16. The card transport device of claim 1 wherein:

said gear train comprises at least one gear having a pitch selected to minimize jitter resulting from movement of the card at said speeds.

17. A card transport device for moving a data-bearing card in a preselected direction past a reading, writing or other communication head during a data reading or writing operation, comprising:

a base oriented along a plane substantially parallel to said card and having opposite side portions;

an electric motor supported by the base;

a worm screw mounted for rotation relative to said base and driven by said electric motor through a gear train;

at least one side plate detachably mounted to one of said side portions;

a drive shaft journaled for rotation within said at least one side plate, said drive shaft carrying a worm wheel driven by said worm screw and at least one drive roller engageable with said card; and a backup roller disposed to urge the card against the drive roller.

18. The card transport device of claim 17 which further comprises:

a pair of said side plates mounted to the side portions of the base; and an upper plate located above said base and held in place by said side plates.

19. The card transport device of claim 18 wherein:

said drive roller engages a data-bearing card from a position beneath the card; and the backup roller further comprises a backup roller mechanism disposed above the card to urge the card against the drive element.

20. The card transport device of claim 19 wherein:

said backup roller mechanism comprises at least two backup rollers carried for axial rotation on a whiffle tree structure mounted for both translational and rotational motion relative to said upper plate.

21. The card transport device of claim 18 wherein:

said side plates are held in alignment with said base by a plurality of alignment tabs which extend outwardly from said base and engage corresponding openings in said side plates.

22. A card transport device for moving a data-bearing card in a preselected direction past a reading, writing or other communication head during a data reading or writing operation, comprising:

a base having opposite side portions;

an electric motor supported by the base;

a first gear mounted for rotation relative to said base and driven by said electric motor;

a drive shaft journaled for rotation relative to said base, said drive shaft carrying a second gear driven by said first gear and at least one drive element engageable with said card;

said drive element engages a data-bearing card from a position beneath the card;

the card transport device further comprises a backup roller mechanism disposed above the card to urge the card against the drive element; and said backup roller mechanism comprises at least two backup rollers carried for axial rotation on a structure mounted for both translational and rotational motion relative to said base.

* * * * *